US005645200A

United States Patent [19]

McDowell et al.

[11] Patent Number: 5,645,200

[45] Date of Patent: Jul. 8, 1997

[54] GARMENT HANGER

[75] Inventors: Philip Richard McDowell, Lake Forest; Robert Wilson McDowell, Gridley; Matthew Fife McDowell, Santa Monica, all of Calif.

[73] Assignee: McDowell Bros., Laguna Hills, Calif.

[21] Appl. No.: 502,529

[22] Filed: Jul. 14, 1995

[51] Int. Cl.[6] ..... A47G 25/40; A47G 25/18; A47G 25/14

[52] U.S. Cl. ..... 223/89; 223/85; 223/94

[58] Field of Search ..... 223/85, 88, 89, 223/94, 95; 211/113; D6/315, 324

[56] References Cited

U.S. PATENT DOCUMENTS

| | | | |
|---|---|---|---|
| 2,653,739 | 9/1953 | Zenk | 223/94 |
| 2,686,620 | 8/1954 | Waldman | 223/88 |
| 2,771,654 | 11/1956 | Moore | 223/DIG. 4 |
| 3,651,999 | 3/1972 | Fiocca | 223/88 |
| 4,310,096 | 1/1982 | Kohlhepp | 223/88 |
| 4,638,931 | 1/1987 | Rieser | 223/88 |
| 5,074,446 | 12/1991 | Suddath | 223/85 |
| 5,163,590 | 11/1992 | Lawler et al. | 223/85 |
| 5,397,037 | 3/1995 | Ozawa | 223/94 |

*Primary Examiner*—Bibhu Mohanty
*Attorney, Agent, or Firm*—Beehler & Pavitt

[57] ABSTRACT

A garment hanger for garments and the like such as a jacket, wherein the garments are suspended from the same hanger, includes a hanger body member having arms extending in generally opposite directions and inclined with respect to each other and adapted to receive and support a jacket and the like. Pivotable rod means are mounted on the hanger body member below the arms for receiving another garment and supporting the same in spaced relation to the arms. Hook means on the hanger body member support the garment hanger on a hook receiving support. The rod means include a rod section located vertically below said arms whereby a garment may be positioned on the rod means absent displacement of a jacket supported by the arms in order to place a garment on the rod means. The arms include angled apertured mating end faces received in the body member and spring biased means are received in the body member, the hook including a portion which passes through the aperture in the end faces. A locking element is positioned between the end faces for securing the hook relative to said arms whereby the hook retains the arms in said body. The rod, arms, hook are angularly positioned relative to each other in a defined relationship.

8 Claims, 3 Drawing Sheets

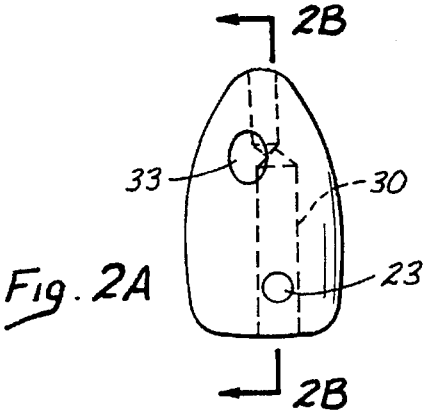
Fig. 2A
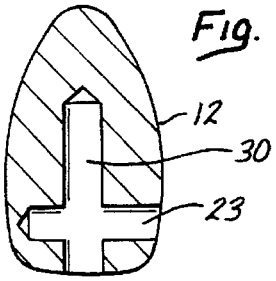
Fig. 2B
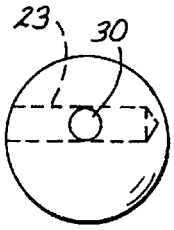
Fig. 2C
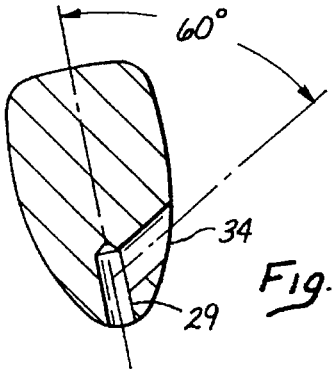
Fig. 2E
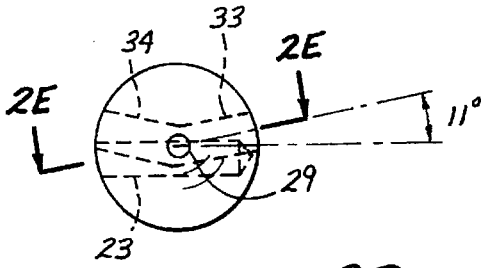
Fig. 2D
Fig. 3A
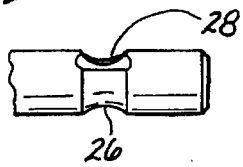
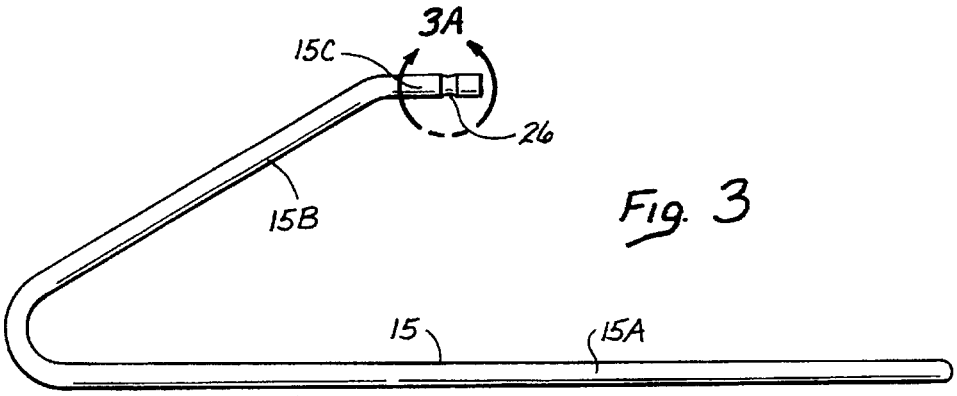
Fig. 3

Fig. 4A
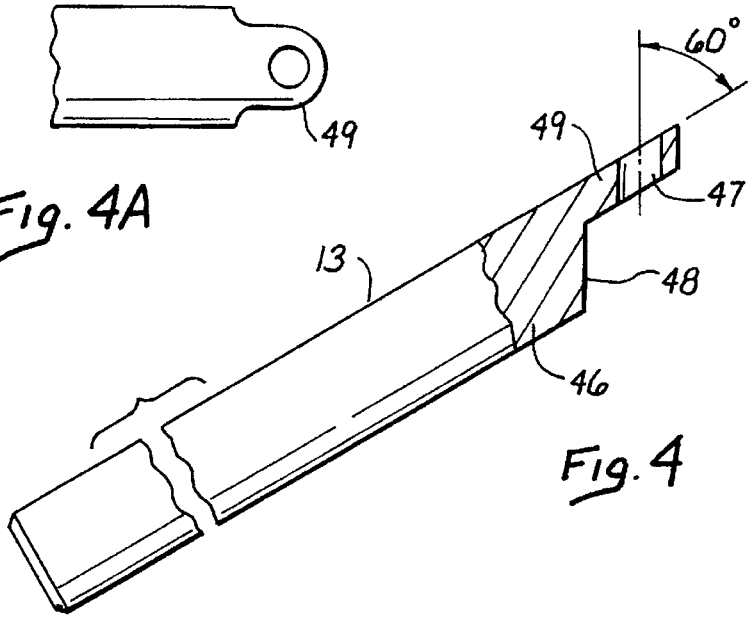
Fig. 4
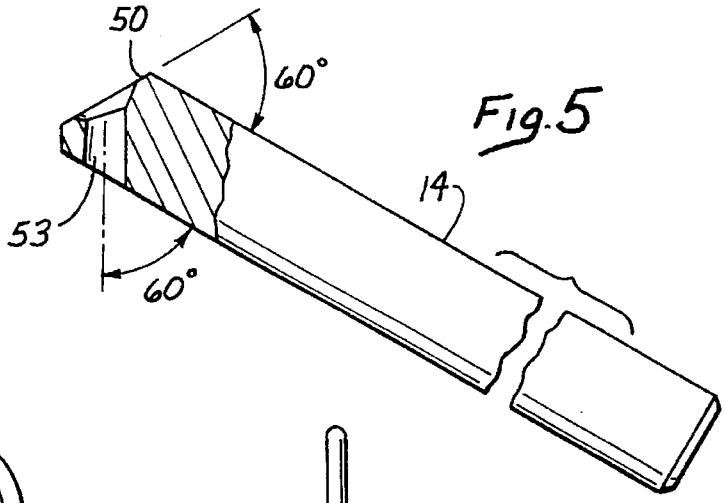
Fig. 5
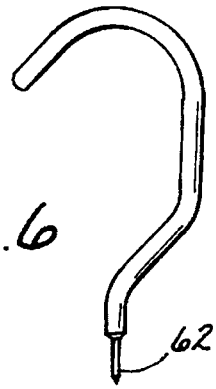
Fig. 6
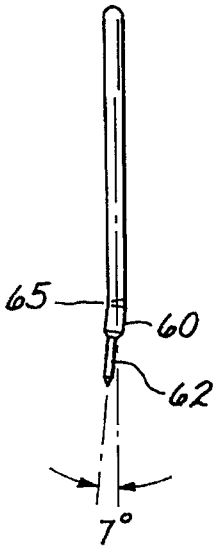
Fig. 6A

GARMENT HANGER

FIELD OF INVENTION

This invention relates to garment hangers and more particularly to an improved garment hanger including a hanger body having a movable arm for accessing a garment supported in spaced relation from the hanger body and displaced therefrom and wherein provision is made for the hanger to be slightly inclined when mounted on a support member for supporting said garments.

BACKGROUND OF THE INVENTION

Garment hangers are well known especially those for mounting and/or storing a jacket and a related garment such as a men's suit including a jacket and trousers. Such hangers may also be used to support women's garments such as a jacket or a dress and a related companion garment such as a skirt or slacks. Regardless of what is supported in the hanger, it is usually mounted on a hanger support element such as a rod in a closet or the like and is normally disposed transversely or at right angles to the rod.

The hanger itself typically includes a hook to hang the hanger, arms to support a jacket or other garment placed thereon. Vertically below the hook and interconnected to the hanger arms is a rod on which another garment may be placed, for example, trousers or slacks or skirt. In the normal use of this type of garment hanger, the garment to be placed on the rod is positioned and the jacket is then placed on the hanger over the first garment, or the order is reversed. Placing the jacket on the hanger arms and then placing the other garment on the rod normally requires that the jacket be opened or removed to gain access to the rod.

In any event, the result is that the garment on the rod is positioned within the jacket located on the hanger arms and basically supported on the rod between the front and back of the jacket and basically covered by the jacket. Since the garment on the rod may not be matched to the jacket, i.e., a sports coat and trousers, or woman's jacket and slacks, as contrasted in each case to a matching suit, it is sometimes necessary to remove the trousers or the like while leaving the jacket on the hanger. This may be accomplished a number of ways, but in each case, the jacket has to be moved, i.e., the front of the jacket has to be opened to access the garment on the rod. While not always the case, more often than not, the jacket is not thereafter hung correctly on the hanger with the result that the jacket becomes wrinkled.

In other cases, a jacket may be on the hanger arms and one may desire to place another garment on the hanger rod, i.e., trousers or slacks and the like. In this case, again the jacket must be moved to access the rod. However, there is the added problem of assuring that the other garment, slacks to trousers, for example, is correctly supported on the rod to avoid wrinkling of the other garment. It is not uncommon for the jacket to be disturbed to hang another garment on the hanger rod, with the result that both the jacket and the other garment are incorrectly hung and become wrinkled.

To some extent, the converse is also true, i.e., when placing a jacket on or removing a jacket from a hanger on which a garment is supported on the hanger arm, one may displace the garment on the rod because it necessary to open and remove the jacket or open and place the jacket over the hanger arms.

It is also the case that the hanger must be properly supported on the supporting rod or other support member so as to avoid wrinkling of the garments on the hanger.

Typically, since the garment on the hanger arms and that on the hanger rod are essentially in the same vertical alignment, there is no major problem. Further, the hanger hook normally is in the same vertical alignment as the hanger arms so that the hanger hook, hanger arms and hanger rod are all in essentially the same vertical plane. Thus, if the hanger and the garments are supported thereon are correctly positioned, wrinkling of the garments is normally avoided. However, the problem still exists with respect to hanging garments on such hangers or removing them where only one of the two garment is hung or removed.

It is apparent that a need exists for a garment hanger which permits easy access to a hanger rod, without disturbing the garment on the hanger arms, so that garments may be placed on or removed from the hanger rod easily and conveniently.

It is also apparent that a need exists for a clothes hanger which is easy to use, reliable, relatively inexpensive and which will assure that garments to be placed on or to be removed from the hanger are easily accessible while reducing the risk of causing one garment to be incorrectly supported by placing or removing another garment from the hanger.

It is also the case that there is a need for an improved garment hanger which permits relatively easy access to the garments, while minimizing the possibility of causing wrinkling of the garments.

BRIEF DESCRIPTION OF THE INVENTION

The present invention relates to a garment hanger and to an improved garment hanger which includes hanger arms mounted on a hanger body which also supports a hanger hook and a hanger rod, the latter so disposed relative to the hanger arms as to allow access to the hanger rod without disturbing the garment on the hanger arms.

In accordance with this invention, the improved garment hanger includes a hanger hook which is laterally displaced relative to the hanger arms, the latter being supported preferably at an inclined relation and downwardly angled orientation so as to form a generally arcuate jacket support. Both the hanger hook and the hanger arms are supported in vertically spaced relation to each other but located on about the same general vertical axis. As is customary, a jacket or other clothing item (shirt, dress, sweater and the like) which can be supported by spaced hanger arms is placed on the hanger arms of the hanger such that the hanger arm extends upwardly for engagement with a support member such as a rod and the like. The hanger of this invention like virtually all other hangers is intended to be supported and disposed such that the hanger arms are generally at right angles to the support member on which the hanger is hung.

To support a second garment such as trousers, slacks and the like, a hanger rod is supported by the hanger body but in a unique orientation with respect to the hanger arms and hanger hook. The hanger rod is disposed vertically below the hanger arms and laterally offset with respect to the arms so as to be laterally spaced therefrom and from the central common axis of the hanger arms and hanger hook.

The hanger rod preferably includes a rod section in the form of a mounting leg joined to an inclined section which is joined to the rod section, the latter being in spaced parallel relation to the mounting leg. The inclined section is angled at about the same angle as the hanger arms but spaced therefrom. In addition, preferably the entire hanger rod is pivotable relative to the hanger body so that the entire unit pivots outwardly away from the hanger arms and may be temporarily set in that position while placing a garment on or removing one from either the hanger arms or hanger rod.

Since the hanger arms and the hanger rod are displaced relative to each other and the hanger hook is centered on the axis of the hanger arm, when garments are placed on the arms and rod, the hanger tends to tilt somewhat with the result that the item on the arms or the rod or both may become wrinkled. To avoid this, the hanger hook includes a mounting section which is axially aligned with respect to the center axis of the hanger arms. The portion of the hanger hook vertically above the support body is inclined at a small angle off the center axis in the direction of the hanger rod so that when garments are placed on the arms and on the rod and the hanger suspended from a support, the garments will hang generally in a vertical orientation without wrinkling.

Due to the relative displacement of the components of the improved hanger, the latter is made up of multiple parts which are easily assembled together. For example, the hanger body is composed of wood or other suitable material while the hanger arms and hanger hook and rod are of metal.

In use, the improved hanger of this invention permits easy hanging or removal of jackets even if slacks or the like are on the hanger rod and easy removal or hanging of slack or the like if a jacket is on the hanger arms. In addition, the clothes supported by the improved hanger tend not to wrinkle even if only a jacket or only slacks or the like are on the hanger due to the arrangement of the hanger hook.

It will be apparent from the following detailed description that the present invention offers a versatile and improved clothes hanger which is easy to use and which reduces the possibility of wrinkling the garments placed on or left on the hanger after removal of only one of the garments. The following description should be considered a description of the invention, as illustrative of the same, and not as a limitation on the same.

DETAILED DESCRIPTION OF THE DRAWINGS

FIG. 2A is a view as seen from the right of the hanger body of FIG. 1 in accordance with this invention;

FIG. 2B is a view partly in section and partly in elevation taken along the line 2B—2B of FIG. 2A;

FIG. 2C is a view as seen from below FIG. 2B;

FIG. 2D is a top view of the hanger body:

FIG. 2E is a view partly in section and partly in elevation taken along the line 2E—2E of FIG. 2D;

FIG. 3 is a perspective view of the hanger rod in accordance with this invention;

FIG. 3A is an enlarged perspective view of the end of the rod in accordance with this invention;

FIG. 4 is a view partly in section and partly in elevation of the left hand hanger arm in accordance with this invention;

FIG. 4A is a view as seen from the top of FIG. 4;

FIG. 5 is a view partly in section and partly in elevation of the right hand hanger arm in accordance with this invention;

FIG. 6 is a view in perspective of the hanger hook in accordance with this invention; and FIG. 6A is a vie of the hanger hook of FIG. 6 as seen from the right side thereof.

DETAILED DESCRIPTION OF THE INVENTION

Figure 1:
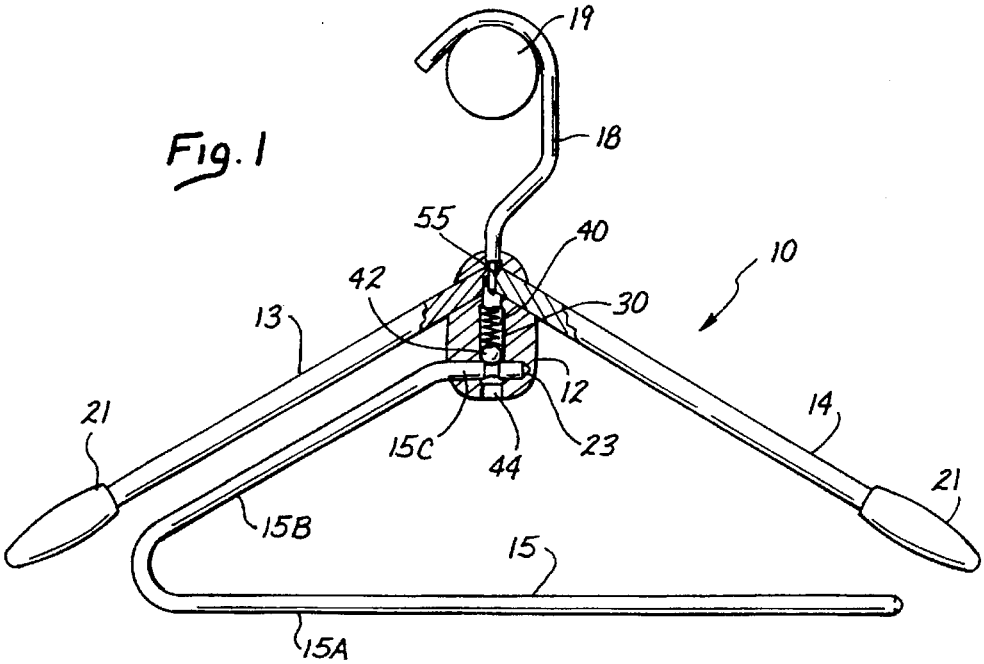
FIG. 1 is a view partly in section and partly in elevation of the improved garment hanger of this invention.
Figure 1A:
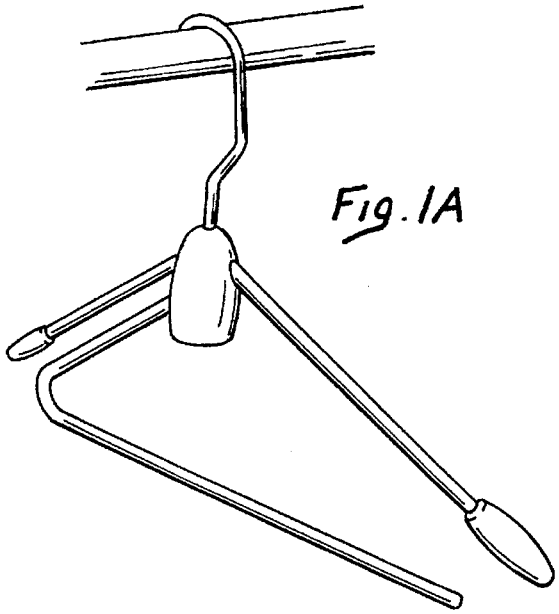
FIG. 1A is a view in perspective as seen from the right of FIG. 1.
Figure 1B:
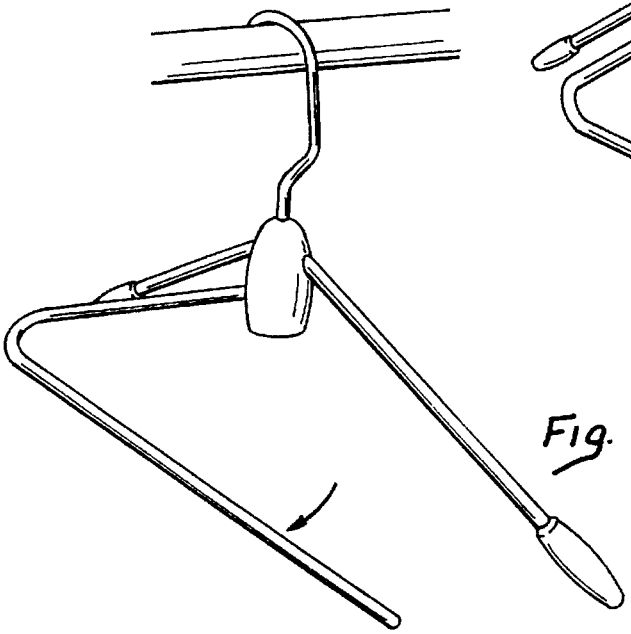
FIG. 1B is a view similar to FIG. 1A illustrating the extended position of the hanger arm.

Referring now to the drawings which illustrate a preferred form of the present invention, FIGS. 1, 1A and 1B show a hanger 10 in accordance with this invention and which is illustrative of the hanger of the present invention. As shown, the hanger 10 is made up of multiple parts such as a hanger body 12, the latter supporting left and right hanger arms 13 and 14 and a hanger rod 15. Also mounted on the hanger body 12 is a hanger hook 18 used to support the hanger 10 on a suitable support such as a support bar 19 as is typically found in most closets.

The hanger body 12 functions as a support for the arms and rod and hook and, in the form shown, is made of wood for esthetic purposes, although other materials such as metal or plastic may be used. The arms and the rod and the hook are made of light weight metal such as aluminum, preferably anodized, for appearance and utilitarian purposes. Again, it is understood that other metals or plastics or a combination thereof may be used for the arms, rod and hook. The ends of the arms 13 and 14 include end knobs 21, again for esthetic purposes, the later preferably of wood and press fitted and glued over the ends of the hanger arms.

As is apparent from FIGS. 1, 1A and 1B, the hanger rod 15 is displaced relative to the hanger arms 13 and 14 in the sense that the latter are in basically spaced parallel relationship with the rod 15 vertically below and laterally offset, as illustrated. As shown, the hanger arms are inclined somewhat so that a jacket cam be placed thereon, and tilted towards each other as will be explained. The result is that hanger arms 13 and 14 form a generally arcuate support for a jacket or the like so that the latter hangs on the arm in a natural manner.

As illustrated (see also FIG. 3), the hanger rod 15 includes a garment mounting leg 15A which is joined to an inclined leg 15B, the latter terminating in rod section 15C which is received in the housing 12. The mounting leg 15A is preferably disposed in a horizontal orientation while the inclined leg 15B is essentially parallel to the adjacent left hanger arm 13, but spaced therefrom laterally and vertically. The rod section 15C is in vertical spaced parallel relationship to the leg 15A so that a garment placed on the leg is supported in a horizontal orientation, but spaced laterally from the hanger arms 13 and 14. In this way a garment, such as slacks or trousers and the like, is supported in spaced relation to a jacket or the like on the hanger arms 13 and 14 and disposed laterally thereof.

The hanger arm 15 is mounted on the housing 12 so as to pivot relative thereto as is seen in FIG. 1B. To this end, the housing 12 whose details are illustrated in FIGS. 2A to 2E includes an aperture 23 extending partly through the housing 12 and on one side thereof which receives the rod section 15C. As shown in FIG. 3A, the rod section includes an annular groove 26 on the outer surface thereof, with a notch 28, forming a detent, located on the upper side of the rod section 15C, the upper side being that side normally facing vertically upwards. As the rod is rotated to the position illustrated in FIG. 1B, the upper side of the rod section is rotated such that the notch is engaged by a spring loaded ball, to be described.

Referring again to FIGS. 2A to 2E, the asymmetrical arrangement of various apertures may be seen. For example, hanger hook aperture 29 which receives the hanger hook 18 is on the axial center line of the body 12, as seen in FIGS. 2A, 2D and 2E. It is also apparent that the center line of the aperture 23 which receives the rod section 15C is offset with respect to the axial center line of the housing 12, as seen in FIGS. 2A and 2D, and in transverse alignment with spring ball aperture 30 as seen in FIGS. 2A and 2C. From FIGS. 2A and 2C, the relative extent of the offset from the center axis can be seen.

Intersecting and communicating with the hanger hook aperture 29 are a pair of apertures 33 and 34, as seen in FIGS. 2A, 2D and 2E, the latter receiving the hanger arms 13 and 14. Thus the intersection of the two hanger arms 13 and 14 is on the center axis, however, the arms are tilted downwardly at an angle of about 60 degrees off the horizontal, i.e., the included angle between the center axis of the housing and the center axis of the arms is 60 degrees, as seen in FIG. 2E. In addition, the arms are angled relative to the transverse axis of the housing about 11 degrees, as seen in FIG. 2D, so that the apex is spaced from the region of the hanger rod 15. The result is the generally downward arc and small arcuate contour of the arms, as seen from the non-parallel relation to the inclined leg section 15B of the hanger rod, tending to follow the natural contour of the shoulders.

As seen in FIG. 1, the aperture 30 which extends upwardly from the bottom of the hanger body 12 receives a coil compression spring 40 and a ball member 42. In the operative position, as illustrated, the spring 40 urges the ball 42 into the annular groove 26 and into the detent 28 as the arm is rotated, as described. The open end of the aperture on the side opposite the hanger rod may be closed by a plug 44.

Referring now to FIGS. 4 and 4A, the mounting end of the left hand arm 13 is illustrated. The end 46 received in the hanger hook aperture 29 (see FIG. 1) is provided with an angled aperture 47 whose angle essentially matches the 60 degree angle of the left arm aperture 33. The end of the left arm 13 in the region of the aperture 47 includes a cut-out section 48 to form a flat section 49 of smaller transverse dimension than the diameter of the arm. The undercut portion provides for engagement with the right hand arm 14.

FIG. 5 shows the details of the right hand arm 14 and especially the end thereof which is received in the hanger hook aperture 29. As seen in FIG. 1, the right hand arm includes an end face 50 which is inclined at 60 degrees (the included angle between the end face and the outer surface of the arm) to fit with the left arm 13. The end face also includes an angled aperture 53, the latter at a 60 degree angle (the included angle as measured to the centerline of the arm). In the assembled position, the end face 50 is oriented in an upward facing position and is located opposite to the mating cut-out section 48 of the left arm.

When properly positioned in the housing and in the respective apertures, the angled apertures 47 and 53 are in alignment and in a general vertical orientation. Received between the ends of the arms received in the hook aperture is an apertured push nut 55 and which functions to hold the arms in place with the hanger hook and all three in place in the housing.

The structure of the push nut is well known and includes a circular body with an internal aperture. The portion between the body and the inner aperture is segmented and forms a plurality of fingers. The fingers or tangs point downwardly and are deflected by the shaft which passes through the aperture, the diameter of the aperture being slightly smaller that the diameter of the mating shaft such that the fingers tightly grip the shaft. Other known structures may be used as a push nut.

The details of the hanger hook 18 are shown in FIGS. 6 and 6A. As shown, the hook 18 includes an angled bottom section 60 at the lower end thereof, the lower end having a reduced diameter section 62 to fit with the angled apertures of the hanger arms and push nut. The angled bottom section 60 extends from just above the reduced diameter section to the end thereof and in positioning in the housing, the hook is pushed in the hanger hook aperture to the region 65 where the angled section starts. The angle of the angled section is about 7 degrees off the vertical and in the direction of the hanger rod. The angled hook is used to assure that the garment on the hanger rod does not bear against the garment on the hanger arms by tilting the hanger and garments thereon a small degree in the direction of the hanger arms.

The assembly of the hanger of this invention is relatively simple. First the compression spring is place in the receiving aperture of the housing and the ball is then inserted. The spring is compressed and the hanger rod is assemble by inserting the rod section 15C until the annular groove is under the ball. A lubricant may be used to avoid squeaking. the bottom open end of the aperture may then be plugged by a plug which may be glued in place. The end knobs may then be glued to the hanger arms. The left hanger arm is inserted into the aperture 33 and a push nut is assembled over the end face of the right arm with care being taken to verify that the tangs are facing downwardly. The right arm and the push nut art then inserted into aperture 34 and the hanger hook is pushed through the aperture of the left arm, the push nut and the aperture of the right arm to complete the assembly.

Based upon the above detailed description, it will be apparent that the improved hanger of this invention includes several unique features which provide a much improved product. The garment on the hanger rod is easily accessible without disturbing the garment on the hanger arms. To assure no disturbance, the hanger rod is pivotable and is detent fixed in a rotated position. The hanger arms are inclined downwardly and in an arcuate orientation following the general natural contour of the shoulders. The hanger rod is displaced downwardly and laterally with respect to the arms so as virtually to guarantee no interference between the two in use and storage.

Further, the hanger hook is angled slightly so as to preclude the garment on the hanger rod from contacting or being contacted by the jacket which is on the hanger arms. Since the jacket or other garment on the hanger arms is normally heavier than the garment on the rod and since the rod is displaced from the arms, the garments would tend not to hang vertically if the hanger hook was on a center and oriented in a true vertical plane.

While the specification has used the terms jacket and trousers or slacks and the like, this is for easy reference it being understood that virtually any garment or the like may be hung on the hanger and other items on the rod section.

It will be apparent from the foregoing detailed description that variations and changes may be made from the structure and arrangement described without departing from the spirit and scope of the present invention as set forth in the appended claims.

We claim:

1. A garment hanger for garments including at least a jacket-like garment and another garment wherein the jacket and the other garment are suspended one within the other from the same hanger, comprising:

a hanger body member having mounted thereon jacket arm means having jacket arms extending in generally opposite directions and adapted to receive and support a jacket;

rod means mounted on said hanger body member below said jacket arms for receiving another garment and supporting the same within said jacket but in laterally spaced relation to and vertically below said jacket arms;

hook means mounted on said hanger body member for supporting said garment hanger on a hook receiving support means;

said hook means being normally oriented in parallel relation to said jacket arms whereby the garment supported by said garment is disposed at right angles to the hook receiving support means;

said rod means including a rod section located vertically below said arms and spaced laterally therefrom whereby a garment may be positioned on the rod means absent displacement of a jacket supported by said jacket arms in order to place a garment on said rod means;

said rod means including a mounting portion received by said body member and a section intermediate said mounting portion and said rod section, said intermediate section being in generally spaced parallel relation to an adjacent jacket arm, said rod means including detent means and said hanger body member includes biased means coacting with said detent means to position said rod means in one of two positions, said mounting portion being in vertical spaced relation in one position and being displaced laterally of said hanger body member in the other position, and said hook means including a first portion thereof vertically above said hanger body member which is vertically oriented and a second portion between said first portion and said hanger body member which is angularly disposed relative to said first portion whereby the garment on said rod means is slightly displaced from the garment on said jacket arm when said hanger with garments thereon is suspended from a garment hanger support.

2. A garment hanger as set forth in claim 1 wherein said rod means are mounted for arcuate pivotal movement laterally with respect to said jacket arms.

3. A garment hanger as set forth in claim 1 wherein said jacket arm means is separate from said hanger body member and being received in said hanger body member.

4. A garment hanger as set forth in claim 3 wherein hanger body member includes aperture means to receive said jacket arm means.

5. A garment hanger as set forth in claim 2 wherein said rod means are mounted for pivotal movement away from said arm means and said body member including a plurality of apertures for receiving said jacket arm means, said hook means and said rod means.

6. A garment hanger as set forth in claim 1 wherein said jacket arm means include arms each extending in opposite directions with respect to said hanger body, said arms being disposed in a generally inclined relation so as to form a support tending to follow the natural contour of the shoulders, and means for within said hanger body member securing said hook means to said arm means and to said hanger body member.

7. A garment hanger as set forth in claim 1 wherein said hanger body member includes a plurality of apertures for receiving said jacket member and said rod means and said hook means, and said hook means being secured to said jacket arm means within said hanger body.

8. A garment hanger for garments and the like such as a jacket, wherein the garments are suspended from the same hanger with one located within the other, comprising:

a hanger body member having mounted thereon jacket arm means including arms extending in generally opposite directions and inclined with respect to each other and adapted to receive and support a jacket;

rod means mounted on said hanger body member below said arms for receiving another garment and supporting the same within the jacket but in lateral spaced relation to said arms;

hook means mounted on said hanger body member for supporting said garment hanger on a hook receiving support means;

said hook means including an angled bottom section received in said hanger body member, said rod means including a rod section located vertically below said arms and spaced laterally therefrom whereby a garment may be positioned on the rod means absent displacement of a jacket supported by said arms in order to place a garment on said rod means;

said rod means being pivotable from one position displaced away from said arms to another position vertically below and in parallel spaced relation to said arms, said rod means including detent means and said hanger body member includes biased means coacting with said detent means to position said rod means in one of two positions, said jacket arm means and said rod means being separate from said hanger body member, said hanger body member including a plurality of apertures therein for receiving said jacket arm means, said hook means and said rod means, and means within said hanger body member to secure said hook means and said jacket arm means together.

* * * * *